US006761474B1

(12) United States Patent
Race

(10) Patent No.: US 6,761,474 B1
(45) Date of Patent: Jul. 13, 2004

(54) PORTABLE SHOP LIGHT WITH EXTENDED HANDLE

(76) Inventor: Donald E. Race, 1765 Center Rd., Saukville, WI (US) 53080

( * ) Notice: Subject to any disclaimer, the term of this patent is extended or adjusted under 35 U.S.C. 154(b) by 0 days.

(21) Appl. No.: 10/435,249

(22) Filed: May 12, 2003

(51) Int. Cl.[7] ..... F21V 21/14
(52) U.S. Cl. ..... 362/486; 362/287; 362/399
(58) Field of Search ..... 362/138, 139, 362/269, 287, 370, 399, 427, 428, 432, 486, 500

(56) References Cited

U.S. PATENT DOCUMENTS 2,219,903 A * 10/1940 Pfauser ..... 362/486
2,580,699 A 1/1952 Pfetzing
3,275,824 A * 9/1966 Hinds ..... 362/486
3,872,295 A 3/1975 Clancy
4,796,172 A * 1/1989 Chestnut ..... 362/427
4,935,854 A * 6/1990 Kernodle ..... 362/486
5,392,201 A 2/1995 Morley et al.
5,959,792 A 9/1999 Ibrahim

* cited by examiner

*Primary Examiner*—Y My Quach Lee
(74) *Attorney, Agent, or Firm*—Richard C. Litman

(57) ABSTRACT

A portable shop light with extended handle is a utility light assembly having an extended handle mounted thereto. The utility light assembly has a pivotally mounted utility light, along with a pair of caster wheels. A support member is affixed to the extended handle to provide an additional point of support so the portable shop light with extended handle may be positioned in a self-stabilized and freestanding manner. An up-turned handgrip end of the extended handle facilitates placement and positioning of the portable shop light with extended handle underneath an automobile or in another low or restricted area.

6 Claims, 4 Drawing Sheets

PORTABLE SHOP LIGHT WITH EXTENDED HANDLE

BACKGROUND OF THE INVENTION

1. Field of the Invention

The present invention relates to shop and utility lighting, and more specifically to a portable shop light with extended handle having an extended handle, casters, and a handle supporting member to facilitate positioning a portable shop light underneath a vehicle, or in another low and inaccessible area, and placement of the portable shop light in a self-stabilized, free-standing manner.

2. Description of the Related Art

The need for easy to use and effective utility and shop lighting is well understood among mechanics and others. Numerous kinds of flashlights, droplights, and utility lights have been used to light work areas. Automobiles present a special need for utility lighting since accessibility for lighting underneath the automobile may be limited and awkward. A utility light that is ideally suited for use underneath an automobile is portable, is easily positioned anywhere underneath the car, has a redirectable light source, and can be positioned in a self-stabilized and freestanding manner.

U.S. Pat. No. 5,392,201, issued on Feb. 21, 1995 to R. Morley et al., discloses a rolling mechanic's lamp. The rolling mechanic's lamp is a frame or platform, having four wheels or casters, and having a light source disposed within the frame or platform. While the rolling mechanic's lamp provides a mobile light source with a low profile for access underneath an automobile, it lacks an extended handle or other means for positioning the light at a distance under the automobile. The light source is not redirectable, limiting its use to situations where a vertically directed light is sufficient.

U.S. Pat. No. 2,580,699, issued on Jan. 1, 1952 to H. Pfetzing, discloses an apparatus for viewing the undercarriage of a vehicle. The apparatus is a large, wheeled, box containing a light source and mirrors. The apparatus is intended for inspection of the vehicle undercarriage. The mirrors facilitate viewing the vehicle undercarriage without having to crawl underneath the car. The apparatus is too bulky, however, for portable use. The apparatus is also of limited use as a utility light source since the lamps it contains are not redirectable, and only a limited reach underneath the vehicle is provided.

U.S. Pat. No. 3,872,295, issued on Mar. 18, 1975 to W. Clancy, discloses an apparatus for inspecting confined areas adjacent to the floor. The Clancy apparatus is similar to the Pfetzing apparatus in that it is intended for inspecting a low and inaccessible space. Like the Pfetzing apparatus, the Clancy apparatus is a wheeled box containing a light source and mirrors. The Clancy apparatus addresses distant positioning of the device with an elongated, extendable handle. It does not, however, provide a redirectable bright light source suitable for use as a utility light for work underneath an automobile.

U.S. Pat. No. 5,959,792, issued on Sep. 28, 1999 to A. Ibrahim, discloses a powered mirror apparatus that is suited to use for vehicle inspection. An elongated pole has a foot on one end, with a lighted mirror assembly mounted thereon. A handle allows the user to manipulate the lighted mirror assembly underneath an automobile for inspection. While the lighted mirror assembly allows a small range of redirection, it lacks a sufficient range of redirectability necessary for a utility light. The device is not intended for an extended reach underneath the automobile, and lacks a means for stabilization once placed.

None of the above inventions and patents, taken either singly or in combination, is seen to describe the instant invention as claimed. Thus a portable shop light with extended handle solving the aforementioned problems is desired.

SUMMARY OF THE INVENTION

The portable shop light with extended handle is a bright, redirectable utility light with an extended handle to facilitate positioning and placement underneath an automobile. A utility light assembly, fixed to one end of the extended handle, has a pivotally mounted utility light to provide a redirectable light source. A pair of caster wheels facilitates movement and positioning of the utility light. The utility light assembly, comprising a light support member, the utility light, and the caster wheels, is fixed to an end of the extended handle. A handle support member mounted midway along the extended handle provides, in addition to the caster wheels, a third supporting point so that the portable shop light with extended handle may be placed in a self-stabilized freestanding position. A handgrip end of the extended handle is formed into an up-turned handgrip. The up-turned handgrip facilitates manipulation of the portable shop light with extended handle underneath an automobile from a standing position.

Accordingly, it is a principal object of the invention to provide a portable shop light with extended handle.

It is another object of the invention to provide a portable shop light with extended handle that is easy to position underneath an automobile or in another low confined space.

It is a further object of the invention to provide a portable shop light with extended handle that may be left stably in place once positioned.

Still another object of the invention is to provide a portable shop light with extended handle that is easy to manipulate underneath an automobile or in another low confined space from a standing position.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
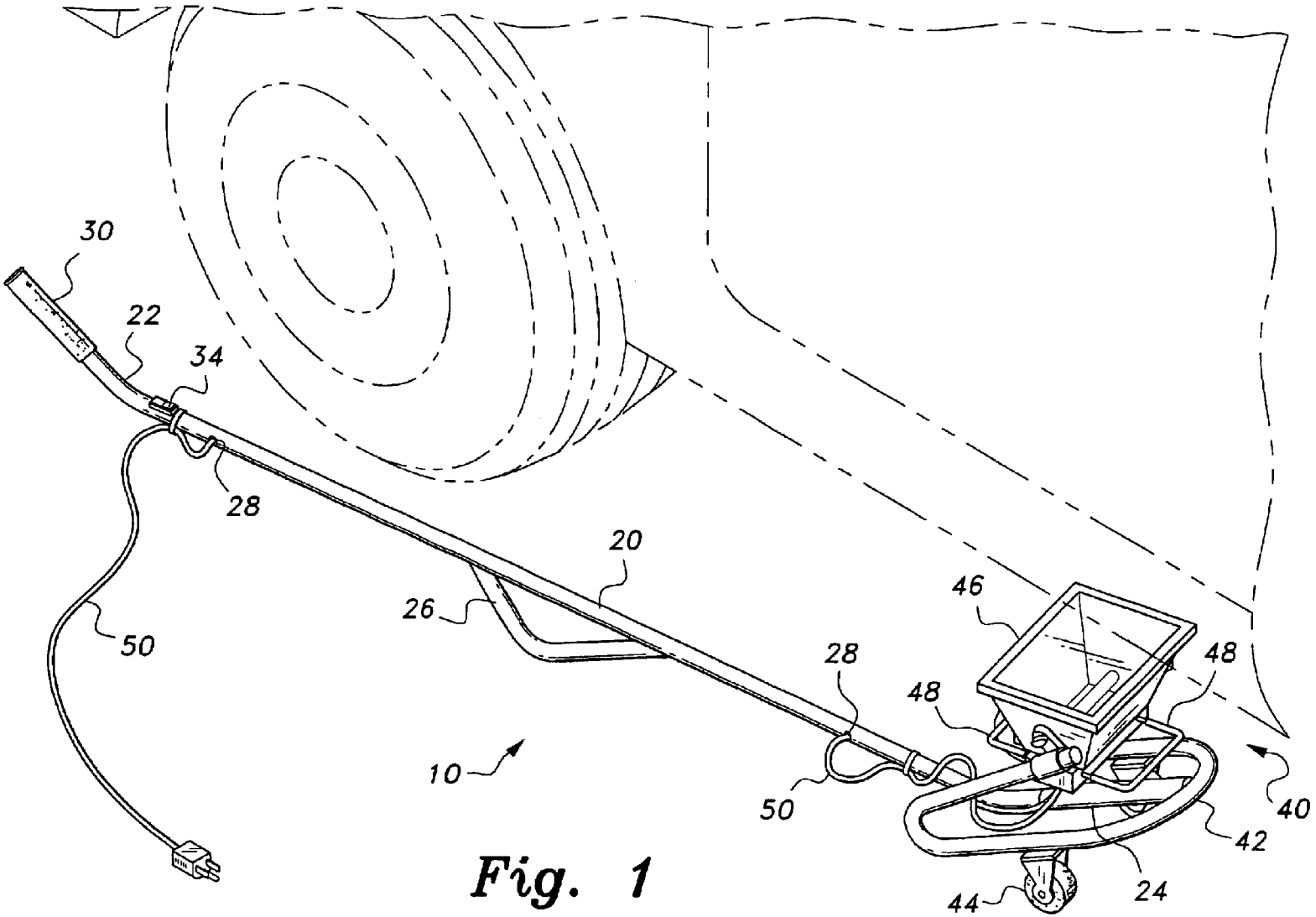
FIG. 1 is an environmental, perspective view of a portable shop light with extended handle according to the present invention.

The present invention is a portable shop light with extended handle, designated generally as 10 in the drawings. As can be seen in FIG. 1, the portable shop light with extended handle 10 is generally comprised of an extended handle 20 having a handgrip end 22 and a light end 24, and a utility light assembly 40 affixed to the light end 24 of the extended handle 20. A handle support member 26 is disposed on the extended handle 20 and provides additional stability and support of the portable shop light with extended handle 10 when in position. The handgrip end 22 of the extended handle 20 is upturned to facilitate handling of the portable shop light with extended handle 10. The extended handle 20 and the handle support member 26 are formed of a round or a square metal tubing, or another suitable material. Apertures 28 may be formed in the extended handle 20 so that an electric power cord 50 may run through the hollow interior of the extended handle 20. Power switch 34 is disposed in the handgrip end 22 of the handle 20, and is in electrical connection with the power cord 50.

Figure 3:
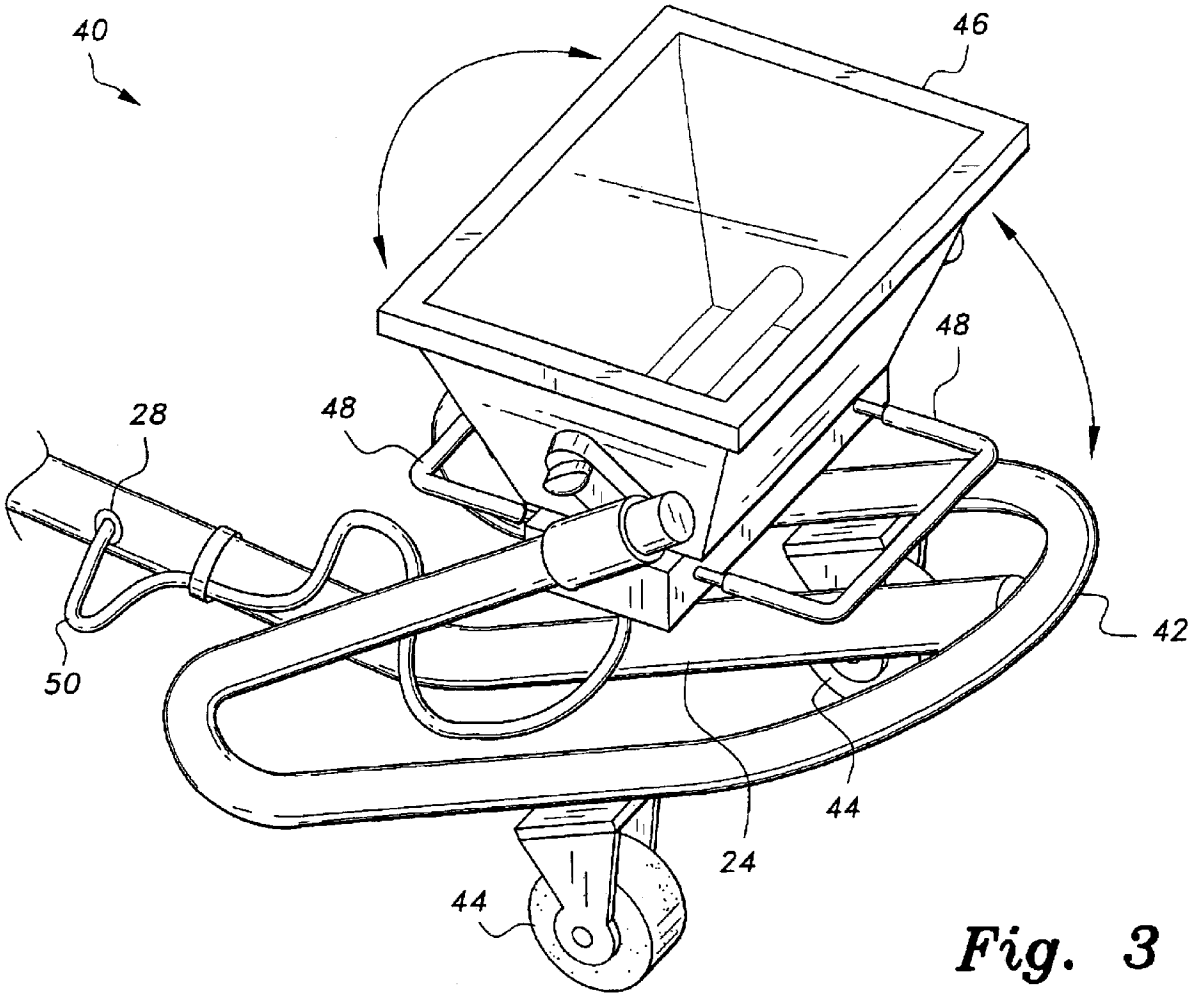
FIG. 3 is a perspective view of the utility light assembly.

The utility light assembly 40, seen more clearly in FIG. 3, comprises a light support member 42 having a pair of substantially parallel arms that is affixed to the light end 24 of the extended handle 20. The light support member 42 is formed of a round or a square metal tubing, or another suitable material. A pair of caster wheels 44 are mounted on the light support member 42. A utility light 46 is pivotally mounted to between the substantially parallel arms of the light support member 42. Handles 48, disposed on the utility light 46, facilitate reorientation of the utility light 46. An electric power cord 50 provides electric power to the utility light 46. The electric power cord 50 may be run through the hollow interior of the extended handle 20, entering an aperture 28 formed in the extended handle 20.

Figure 2:
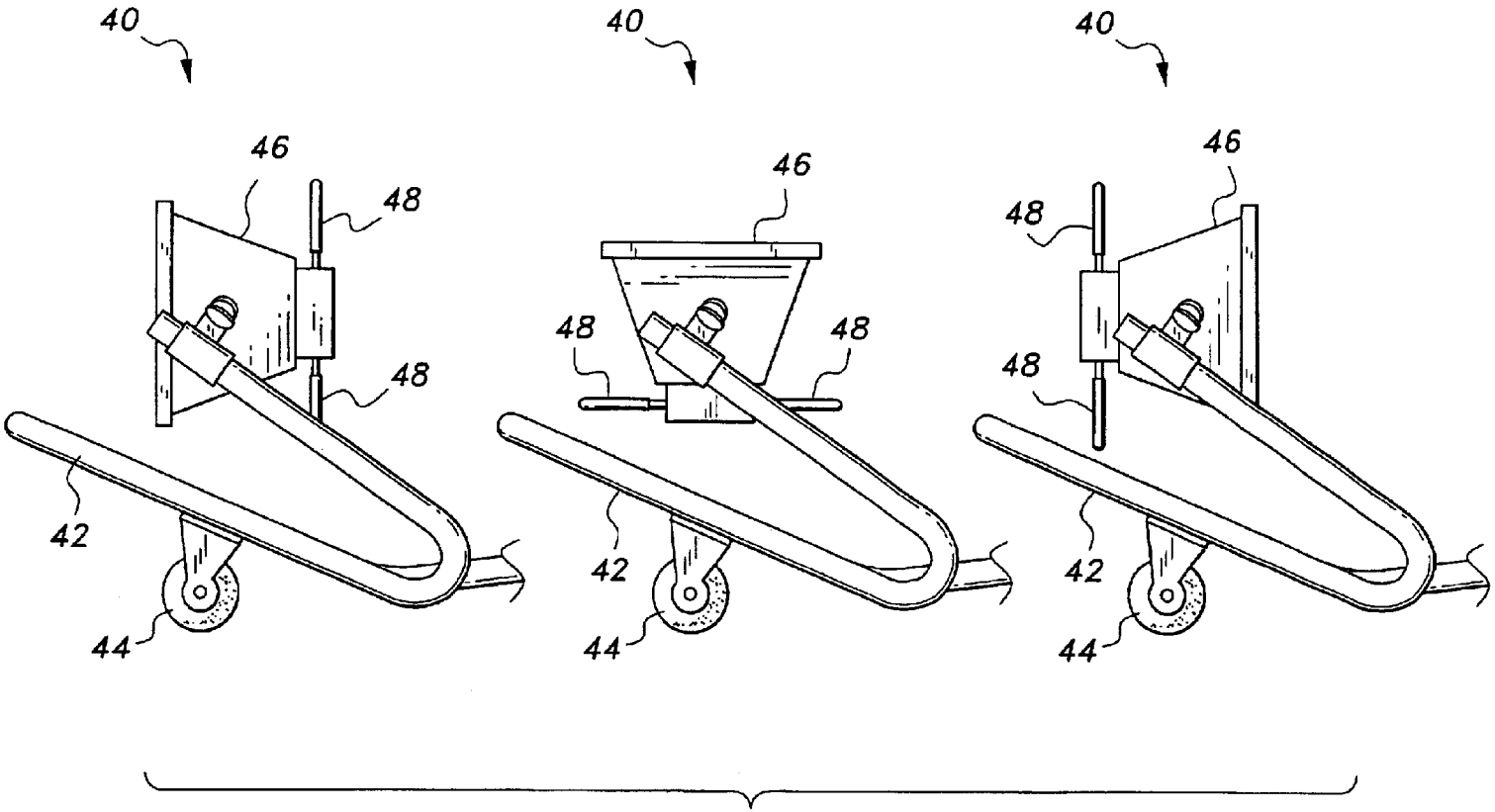
FIG. 2 is a side view of the utility light assembly showing the utility light pivoted into a forward position, an upright position, and a backward position.

As seen in FIG. 2, the utility light 46 is fully adjustable from a forward direction to an upright direction to a backward direction.

Figure 4B:
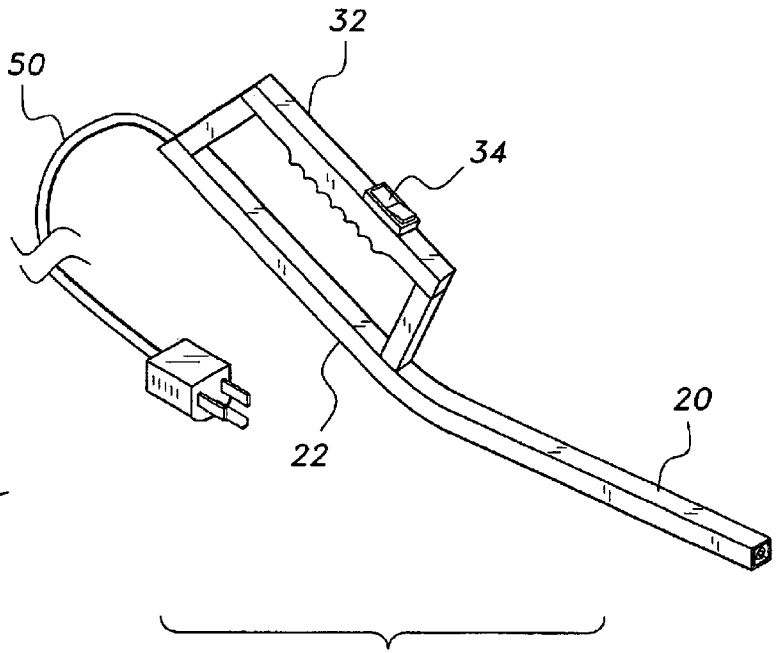
FIG. 4B is a partial view showing the handle end of the portable shop light with extended handle having an enclosed hand grip.
Figure 4A:
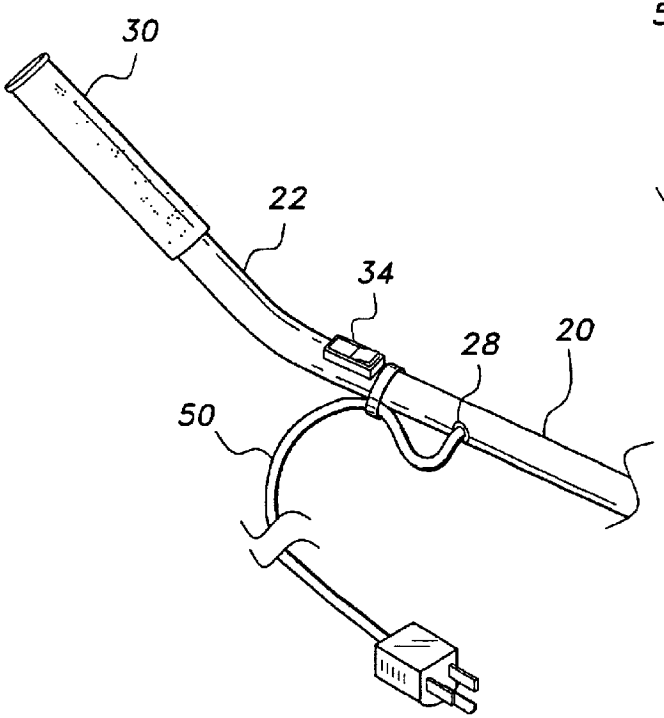
FIG. 4A is a partial view showing the handle end of the portable shop light with extended handle having a simple handgrip.

A handgrip is disposed on the handgrip end 22 of the extended handle 20. A simple handgrip 30, seen in FIG. 4A, is a rubber or plastic material disposed on the handgrip end 22. A preferred handgrip is an enclosed handgrip 32, seen in FIG. 4B. The electric power cord 50 may exit from the extended handle 20 through an aperture 28 formed in the extended handle 20 as seen in FIG. 4A, or through the end of the extended handle 20 as seen in FIG. 4B.

It is to be understood that the present invention is not limited to the embodiment described above, but encompasses any and all embodiments within the scope of the following claims.

I claim:

1. A portable shop light with extended handle, comprising:

an extended handle having a handgrip end and a light end;

a light support member disposed on the light end of said extended handle, the light support member having a pair of substantially parallel arms;

a plurality of caster wheels disposed on said light support member;

a utility light pivotally mounted between the arms of said light support member; and the utility light having an electric power cord.

2. The portable shop light with extended handle according to claim 1, further comprising a handle support member depending from said extended handle.

3. The portable shop light with extended handle according to claim 1, further comprising a handgrip disposed on said handgrip end of said extended handle.

4. The portable shop light with extended handle according to claim 3, wherein said handgrip is an enclosed handgrip.

5. The portable shop light with extended handle according to claim 4, further comprising a power switch disposed in said enclosed handgrip, the power switch being in electrical connection with said electric power cord.

6. The portable shop light with extended handle according to claim 1, further comprising a power switch disposed in said handgrip end of said extended handle, the power switch being in electrical connection with said electric power cord.

* * * * *